US007264535B2

(12) United States Patent
Guthrie et al.

(10) Patent No.: US 7,264,535 B2
(45) Date of Patent: Sep. 4, 2007

(54) RUN-TO-RUN CONTROL OF BACKSIDE PRESSURE FOR CMP RADIAL UNIFORMITY OPTIMIZATION BASED ON CENTER-TO-EDGE MODEL

(75) Inventors: Hung- Chin Guthrie, Saratoga, CA (US); Ming Jiang, San Jose, CA (US); Yeak-Chong Wong, San Jose, CA (US)

(73) Assignee: Hitachi Global Storage Technologies Netherlands, B.V. (NL)

( * ) Notice: Subject to any disclaimer, the term of this patent is extended or adjusted under 35 U.S.C. 154(b) by 292 days.

(21) Appl. No.: 10/831,592

(22) Filed: Apr. 23, 2004

(65) Prior Publication Data

US 2005/0239222 A1 Oct. 27, 2005

(51) Int. Cl.
*B24B 49/00* (2006.01)

(52) U.S. Cl. ..... 451/5; 451/41

(58) Field of Classification Search ..... 451/5, 451/6, 10, 11, 41, 57

See application file for complete search history.

(56) References Cited

U.S. PATENT DOCUMENTS 5,653,622 A * 8/1997 Drill et al. ..... 451/5
6,059,636 A * 5/2000 Inaba et al. ..... 451/5

OTHER PUBLICATIONS

Duane Boning et al., "Run by Run Control of Chemical-Mechanical Polishing", IEEE Trans. CPMT©, vol. 19, No. 4, pp. 307-314, Oct. 1996.

Roland Telfeyan et al., "A Multi-Level Approach to the Control of a Chemical-Mechanical Planarization Process", Journal of Vacuum Science and Technology, Feb. 19, 1996, pp. 1-20.

(Continued)

*Primary Examiner*—Robert A. Rose
(74) *Attorney, Agent, or Firm*—Silicon Valley Patent Group LLP; Omar K. Suryadevara

(57) ABSTRACT

During planarization of wafers, the thickness of a layer of a wafer is measured at a number of locations, after the wafer has been planarized by chemical mechanical polishing. The thickness measurements are used to automatically determine, from a center to edge profile model to which the measurements are fit, a parameter that controls chemical mechanical polishing, called "backside pressure." Backside pressure is determined in some embodiments by a logic test based on the center-to-edge profile model, coefficient of determination R-square of the model, and current value of backside pressure. Note that a "backside pressure" set point is adjusted only if the fit of the measurements to the model is good, e.g. as indicated by R-square being greater than a predetermined limit. Next, the backside pressure that has been determined from the model is used in planarizing a subsequent wafer.

21 Claims, 6 Drawing Sheets

OTHER PUBLICATIONS

Chadi El Chemali et al., Multizone Uniformity Control of a Chemical Mechanical Polishing Process Utilizing a Pre and Post-Measurement Strategy, Journal of Vacuum Science and Technology A 18, No. 4 (Jul./Aug. 2000); 1287-1296, pp. 1-28.

Jiyoun Kim et al., "Gradient and Radial Uniformity Control of a CMP Process Utilizing a Pre-and Post- Measurement Strategy", Proceedings of the Fifth Int'l Chemical Planarization of ULSI Multilevel Interconnection Conference (CMP-MIC) (Tampa, FL: IMIC, 2000), 215-221, 8 pages.

Anthony J. Toprac, "Development and implanting an advanced CMP run-to-run controller", Micro Magazine, Aug./Sep. 2003, 8 pages.

A. Scott Lawing, Rodel, "Improving the results of post-CMP wafer-scale thickness measurements", Micro Magazine, Cannon Publications, LLC, Jan. 2002, 9 pages.

Jason Groce, "Advanced Process Control Framework Initiative (APCFI) Project: Overview", Technology Transfer #99053735A-TR, International SEMATECH, Jun. 30, 1999, 28 pages.

* cited by examiner

| R2 | CTE | BSP | Action to adjust BSP |
|---|---|---|---|
| below/= 0.4 | <-100 | <1.6 | 0 |
| below/= 0.4 | <-100 | 1.6 to 2.4 | 0 |
| below/= 0.4 | <-100 | > +2.4 | 0 |
| below/= 0.4 | -100 to 200 | <1.6 | 0 |
| below/= 0.4 | -100 to 200 | 1.6 to 2.4 | 0 |
| below/= 0.4 | -100 to 200 | > +2.4 | 0 |
| below/= 0.4 | > +100 | <1.6 | 0 |
| below/= 0.4 | > +100 | 1.6 to 2.4 | 0 |
| below/= 0.4 | > +100 | > +2.4 | 0 |
| above 0.4 | <-100 | <1.6 | 0 |
| above 0.4 | <-100 | 1.6 to 2.4 | **-0.05** |
| above 0.4 | <-100 | > +2.4 | **-0.05** |
| above 0.4 | -100 to 200 | <1.6 | 0 |
| above 0.4 | -100 to 200 | 1.6 to 2.4 | 0 |
| above 0.4 | -100 to 200 | > +2.4 | 0 |
| above 0.4 | > +200 | <1.6 | **0.05** |
| above 0.4 | > +200 | 1.6 to 2.4 | **0.05** |
| above 0.4 | > +200 | > +2.4 | 0 |

FIG. 4H

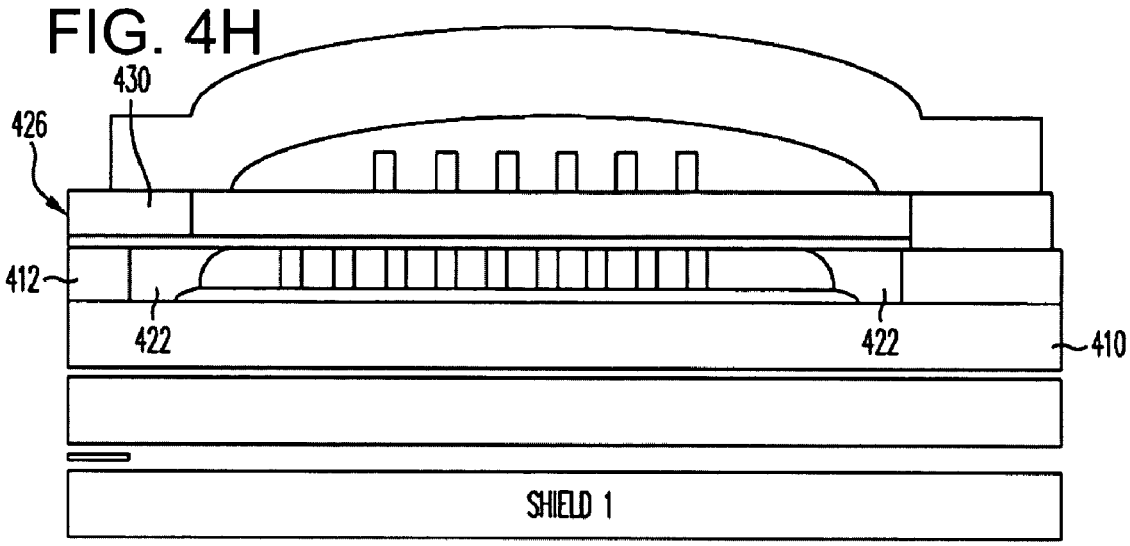

FIG. 4F

| LIMIT test number | test name | | test action | action when |
|---|---|---|---|---|
| #1 | R2 limit test | LSL=0.4 | none | passed |
| #2 | CTE High limit test | USL=+200 | none | failed |
| #3 | CTE Low limit test | LSL=-100 | none | failed |
| #4 | BSP High limit test | USL=+2.4 | none | failed |
| #5 | BSP Low limit test | LSL=1.6 | none | failed |
| #6 | BSP in-range limit test | LSL=1.6 , USL=2.4 | none | passed |

FIG. 4G

| LOGIC test | test expression | test action |
|---|---|---|
| 1 | NOT{ ( #1 AND NOT(#3) AND #6) OR (#1 AND NOT(#3) AND NOT(#4)) } | tune: BSP - 0.05 |
| 2 | NOT{ (#1 AND NOT(#2) AND NOT(#5)) OR (#1 AND NOT(#2) AND #6) } | tune: BSP + 0.05 |

RUN-TO-RUN CONTROL OF BACKSIDE PRESSURE FOR CMP RADIAL UNIFORMITY OPTIMIZATION BASED ON CENTER-TO-EDGE MODEL

BACKGROUND

During processing of semiconductor substrates that are to contain integrated circuits and/or heads of disk drives (such as read and write heads), it is common to planarize a wafer by use of chemical mechanical polishing (CMP). Typical chemical mechanical polishing (CMP) systems use a polishing arm and carrier assembly 110 (FIG. 1A) that press the top surface of a semiconductor wafer 101 against a rotating polishing pad 102 mounted on a platen 120.

Post-CMP within wafer non-uniformity (WIWNU) could depend on many factors such as incoming wafer film uniformity, down force, wafer curvature back-side-pressure (BSP), wafer to retaining ring protrusion, retaining ring pressure, pad, conditioning, table and carrier speed, slurry distribution, oscillation, etc. However, inventors note that the effect from back-side-pressure (BSP) on post-CMP uniformity is much more significant than other parameters. We found that Post CMP wafer uniformity is dominated by polishing BSP.

Bow (convex) is the typical global geometry of wafer deformation due to the wafer substrate bow and film stress. The compressive stress from deposition processing causes convex bending. Based on the incoming wafer and process maps, the back-side-pressure in the process recipe can be adjusted to bend wafer by positive, vacuum, or radical zone back-side-pressure and optimized to obtain polishing uniformity or compensate for film center-to-edge thick or thin incoming film thickness. Back-side-pressure can push the back of a wafer and accelerate the center polishing rate for center-thick-edge-thin film or center-slow-edge-fast process. It also can vacuum the back of the wafer and decrease the center polishing rate for the center-fast-edge-slow process.

SUMMARY

In accordance with the invention, during fabrication of wafers (such as substrates with or without additional layers formed thereon), the thickness of a layer of a wafer is measured at a number of locations, after the wafer has been planarized by chemical mechanical polishing. The thickness measurements are fit to a computer model (such as a straight line) which is used to automatically determine a parameter that controls chemical mechanical polishing, called "backside pressure." A backside pressure determined from such a model is used in future chemical mechanical polishing, i.e. in planarizing a subsequent wafer.

Note that the newly determined backside pressure (and in most embodiments the computer model itself) is used in accordance with the invention only if the fit of the measurements to the model is good, e.g. as indicated by the coefficient of determination R-square being greater than a predetermined limit. If the fit (of the measurements to the model) is poor, then the backside pressure is kept unchanged.

Several embodiments of the invention automatically fit thickness measurements to a straight line which models the center-to-edge profile of the already-planarized wafer. Such embodiments automatically compute the backside pressure using a slope of the straight line, for example to determine the difference in thickness between the center and edge of the wafer and checking against a predetermined range.

Although wafers of semiconductor material are described in the previous paragraph, as would be apparent to the skilled artisan, wafers of any kind that are planarized with application of backside pressure can be fabricated in the manner described herein. Moreover, although a straight line model of the profile is described at the beginning of this paragraph, other embodiments use other models, such as a curve that is represented in the computer by a polynomial of second degree or third degree.

BRIEF DESCRIPTION OF THE DRAWINGS

FIG. 4F illustrates, in a table, six limit tests that summarize the tests shown in FIG. 4E.

FIG. 4G illustrates, in a table, logic tests that are applied to six tests of FIG. 4F in one exemplary embodiment of the invention.

FIG. 4H illustrates, in a cross-sectional view, a read-write head that is fabricated using the exemplary embodiment of FIGS. 4E-4H.

DETAILED DESCRIPTION

Figure 1:
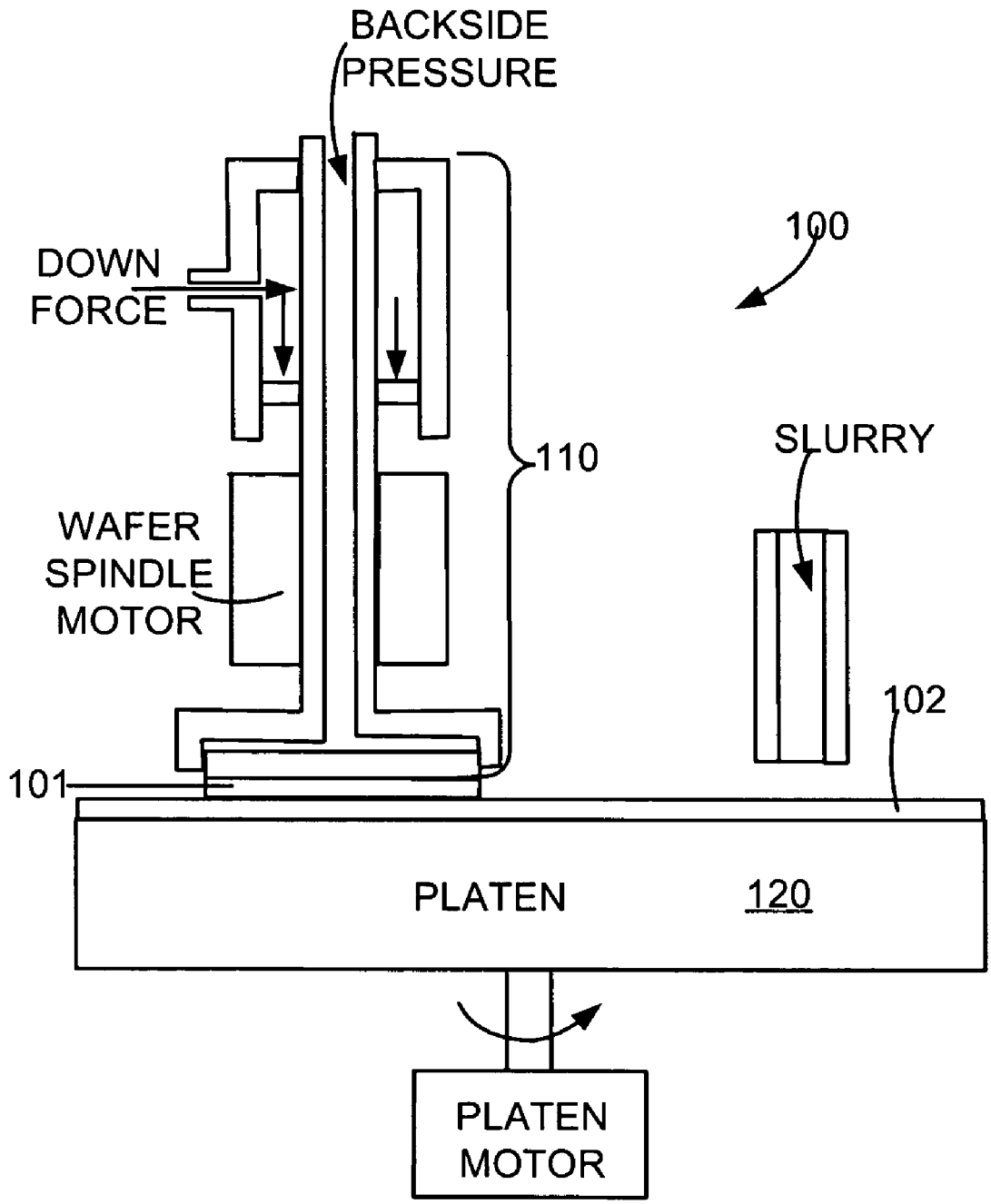
FIG. 1 (prior art)
FIG. 1 illustrates, in a cross-sectional view, a prior art tool for chemical mechanical polishing of a wafer.

In accordance with some embodiments of the present invention, a system 200 (FIG. 2A) for use in planarizing wafers 231 and 232 includes a chemical mechanical polishing (CMP) tool 100 of the type shown in FIG. 1. Note that tool 100 can be any CMP tool that allows backside pressure to be changed, such as, for example CMP tools available from Strasbaugh, Applied Material and Ebarra.

In addition, system 200 also includes a metrology tool 210 that is located adjacent to CMP tool 100, to receive therefrom a wafer 231 that has been planarized by tool 100. Metrology tool 210 can be also any tool commonly available and used for measuring thickness of a planarized wafer, such as, for example, a metrology tool available from Nanometrics. Furthermore, system 200 also includes a computer 220 that is coupled directly or indirectly to each of the metrology tool 210 and chemical mechanical polishing tool 100.

Note that wafers 231 and 232 of some embodiments are substrates of semiconductor material (such as silicon) on which are formed one or more layers of other materials, such a conductive material and/or dielectric material (e.g. metal layer and oxide layer). Wafers 231 and 232 can be, for example, semiconductor substrates that are partially fabricated to contain one or more layers of materials used to form integrated circuits and/or read-write heads of the type used in disk drives. However, it is to be understood that other kinds of wafers (such as reticles or optical lenses) may also be planarized in the manner described herein, depending on the embodiment.

Figure 2A:
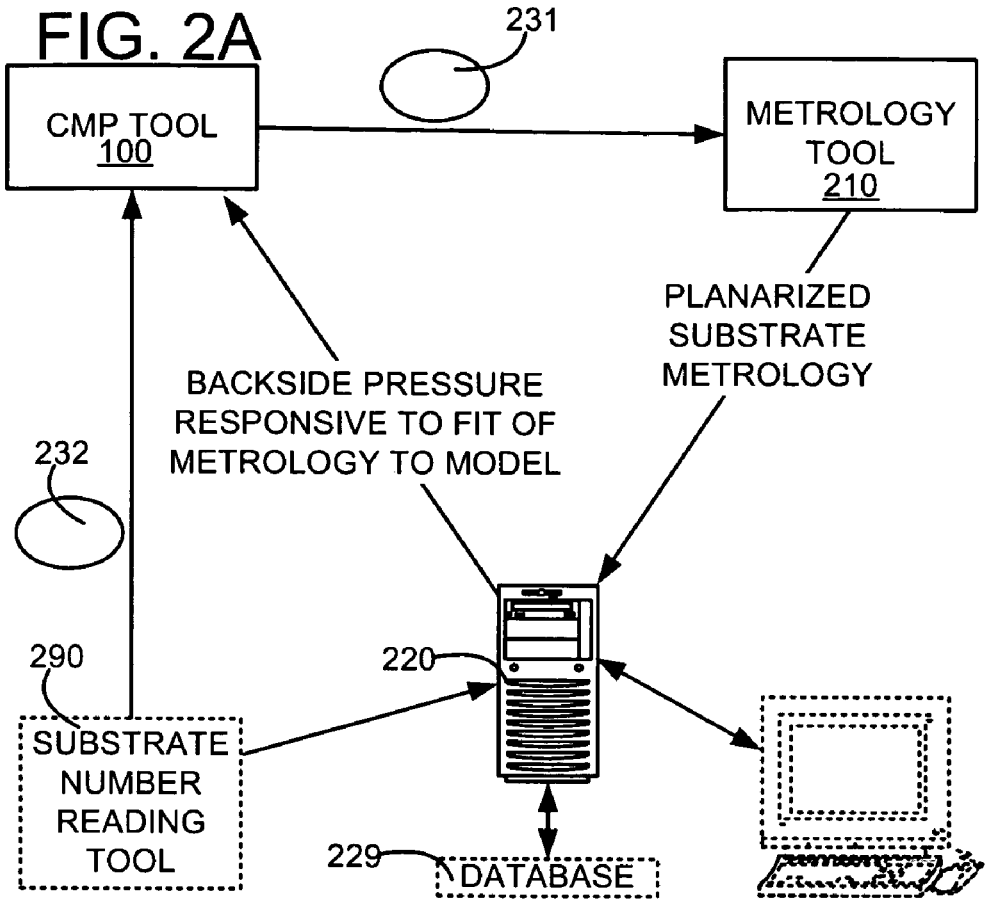
FIG. 2A illustrates, in a block diagram, use of the CMP tool of FIG. 1 in a system in accordance with the invention, including a metrology tool to generate wafer metrology and a computer to generate based on the metrology, a backside pressure for use by the CMP tool of FIG. 1.
Figure 2B:
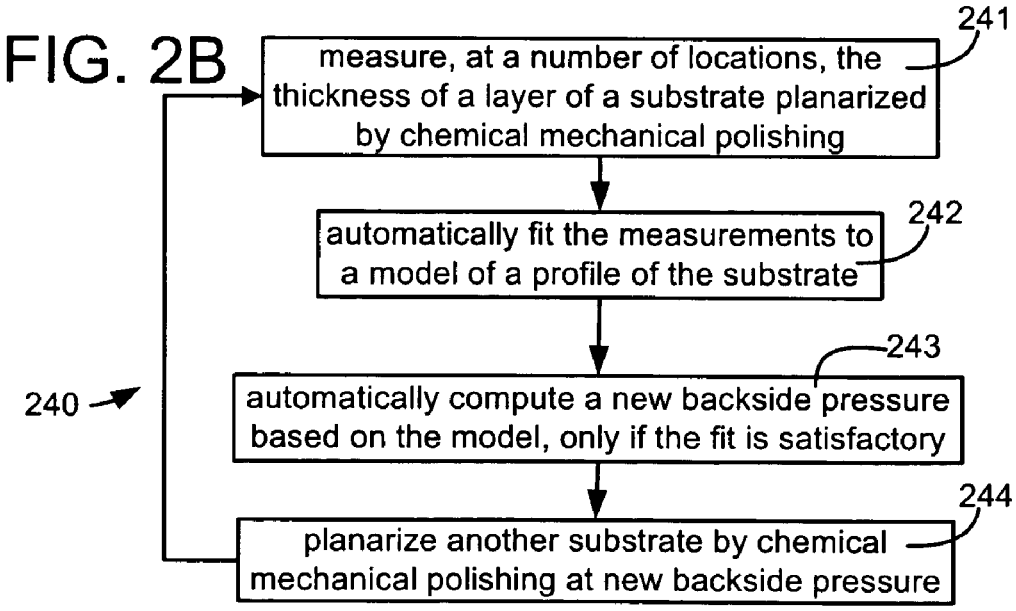
FIG. 2B illustrates, in a flow chart, acts 241-244 performed by the system of FIG. 2A when performing a method in accordance with the invention.

In several embodiments, metrology tool 210 measures the thickness of an upper-most layer of planarized wafer 231 at a number of locations, as per act 241 (FIG. 2B). Computer 220 receives the measurements from tool 210 (FIG. 2A). Computer 220 is programmed in accordance with the invention to automatically fit the measurements to a model of the profile of the upper-most layer, as per act 242 (FIG. 2B). The model can be, for example, a straight line which models the center-to-edge profile of the already-planarized wafer 231. Although a straight line model is used in some embodiments, other embodiments use other models, such as a curve that is represented in the computer by a polynomial of second degree or third degree.

Next, computer 220 automatically computes a new backside pressure based on the model, but only if the measurements fit the model in a satisfactory manner, as per act 243 (FIG. 2B). Satisfactoriness of fit is determined by computer 220 by applying a predetermined test on a statistical indicator of fitness, such as the coefficient of determination R-square, depending on the embodiment. Computer 220 supplies the new backside pressure to chemical mechanical polishing tool 100 which in turn uses this new pressure in future, to planarize another wafer, as per act 244. Some embodiments control the operation of CMP tool 100 at every run, in which case CMP tool 100 is operated at the new backside pressure in the very next run.

In this manner, method 240 (FIG. 2B) makes backside pressure for chemical mechanical polishing responsive to the fit of metrology (of planarized wafers) to a computer model. In several embodiments of the type described above, computer 220 implements feedback control of chemical mechanical polishing in CMP tool 100. In addition, some embodiments of computer 220 also implement a feedforward control of CMP tool 100, e.g. by use of metrology of a wafer 232 prior to planarization. Such metrology may be retrieved by computer 220, from a database 229, using an identity of the wafer 232. Wafer 232 that is about to be planarized may be identified in the normal manner, by an identification number located thereon, which is read by tool 290 (FIG. 2A) and supplied to computer 220.

The hardware in computer 220 is no different from any off-the-shelf computer that is normally coupled to CMP tool 100. Such a computer 220 includes a processor that receives thickness measurements via a network interface that may be, for example, a local area network (LAN) card coupled to CMP tool 100. Moreover, processor in computer 220 is coupled to a memory and receives therefrom a limit on the fitness of the measurements to the model. In one example, the value 0.4 is used as a limit on the coefficient of determination R-square which is used as a fitness indicator.

Memory of computer 220 also holds software (i.e. sequences of instructions to be executed by processor, in the form of an executable computer program) for fitting the measurements to the model. For example such software may use any regression technique(s) well known in the art. Memory also holds additional software for processor to compute the new backside pressure from the model. For example, such software may cause processor to automatically use a slope of the line that models the center-to-edge profile of wafer 231, to determine a change to be made to the current backside pressure.

As noted above, computer 220 of several embodiments is programmed to automatically use a slope of a line 313 (FIG. 3A) that models the center-to-edge profile of wafer 231 to determine a change to be made to the current backside pressure. Line 313 is located between a center 311 and an edge 312 of wafer 231. When so programmed, computer 220 compares (a) the difference in thickness between the center and edge of wafer 231 as computed from a slope of the straight line 313 and (b) a predetermined range, to see if the difference falls below, within or above the range, as per act 321 in FIG. 3B. The just-described "difference" is also referred to below as "CTE thickness" wherein CTE is an abbreviation of "center-to-edge".

Figure 3B:
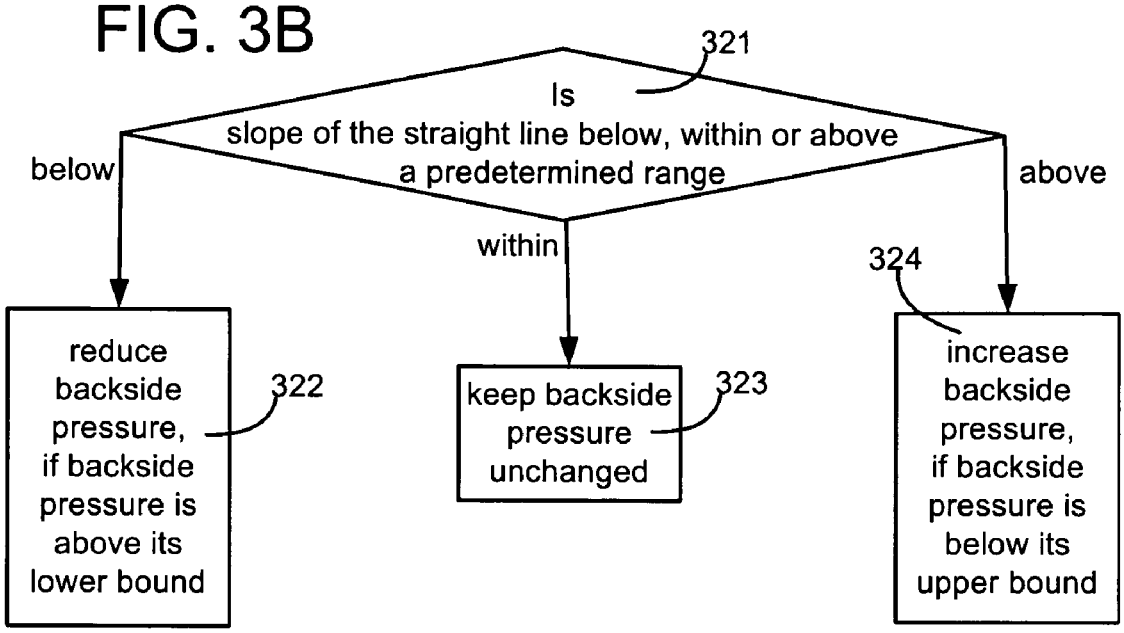
FIG. 3B illustrates, in a flow chart, acts performed by a computer containing the model of FIG. 3A, in several embodiments of the invention.

If the CTE thickness is below the range, computer 220 is programmed to reduce the current backside pressure, if the current backside pressure is above a lower bound, as per act 322 in FIG. 3B. Hence, CTE thickness being below the range is grounds for reducing the backside pressure, but not below the lower bound. Moreover, if the CTE thickness is within the range, computer 220 is programmed to keep the current backside pressure unchanged, as per act 323 in FIG. 3B. Finally, if the CTE thickness is above the range, computer 220 is programmed to increase the current backside pressure, if the current backside pressure is below an upper bound, as per act 324 in FIG. 3B.

FIGS. 4A-4H illustrate one specific implementation of an exemplary embodiment in accordance with the invention. In the exemplary embodiment, the backside pressure in the process recipe is adjusted to bend a wafer by positive, vacuum, or radical zone. Specifically, the backside pressure is optimized to obtain polishing uniformity or compensate for a wafer that is center-to-edge thick or thin prior to planarization. Backside pressure is adjusted to push the back of a wafer and accelerate the center polishing rate for a center-thick-edge-thin wafer or for a center-slow-edge-fast process. Moreover, the backside pressure is also used to vacuum the back of the wafer and decrease the center polishing rate for a center-fast-edge-slow process.

Figure 4A:
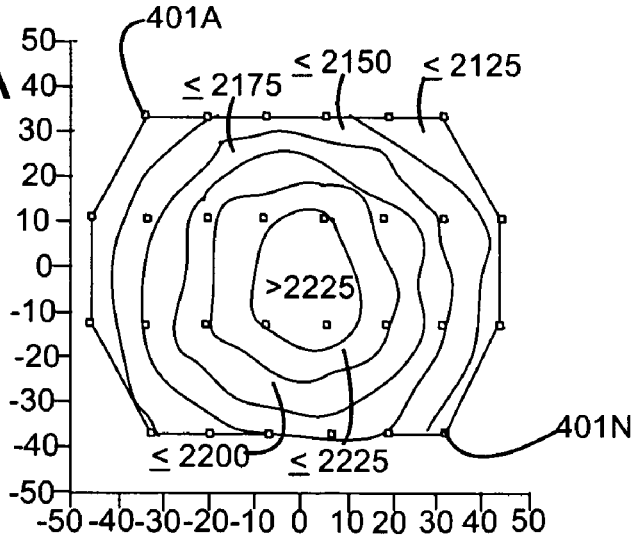
FIG. 4A illustrates, in a contour map, the varying thicknesses of a wafer after chemical mechanical polishing in one embodiment of the invention.

In this specific embodiment, which is described below in greater detail in reference to FIGS. 4A-4H, advanced process control (APC) implements run to run closed loop control to adjust the backside pressure to improve wafer non-uniformity (WIWNU). An optimized backside pressure (BSP) is estimated based on historical run to run center-to-edge (CTE) uniformity data, as shown in FIGS. 4E-4G (discussed below). Moreover, a specific polishing BSP setting for each wafer is calculated based on the optimized BSP, as well as feed forward data (e.g. incoming wafer's non-uniformity in deposition thickness). APC based on metrology of the planarized wafers speeds up the feedback of BSP control. With run-to-run (R2R) CTE BSP control, the CMP WIWNU is improved by 20%-30% in this embodiment.

We found that in this specific embodiment, there are two components of within wafer non-uniformity: radial non-uniformity (that is affected by CMP) and gradient non-uniformity (that is affected by the tooling previously used on the incoming wafer). The wafer non-uniformity from CMP is radial non-uniformity even with incoming wafer having a gradient non-uniformity from $Al_2O_3$ fill deposition. The CMP radial non-uniformity is controlled by changing the BSP based on the slope of the center-to-edge profile.

In the exemplary embodiment of FIG. 4A, twenty-eight measurements are made on wafer 231 after planarization, at locations 401A-401N that are arranged uniformly in a two dimensional array. Note that in FIG. 4A, the locations for measurements form four rows, with six locations in the top and bottom rows, and eight locations in the two middle rows. Also shown in FIG. 4A are contour plots of equal thickness measurements averaged over 1000 wafers that are planarized using BSP computed as noted above, resulting in a maximum thickness >2225 Angstroms in the center of the wafer, and ≦2125 Angstroms at the edge of the wafer.

Figure 4B:
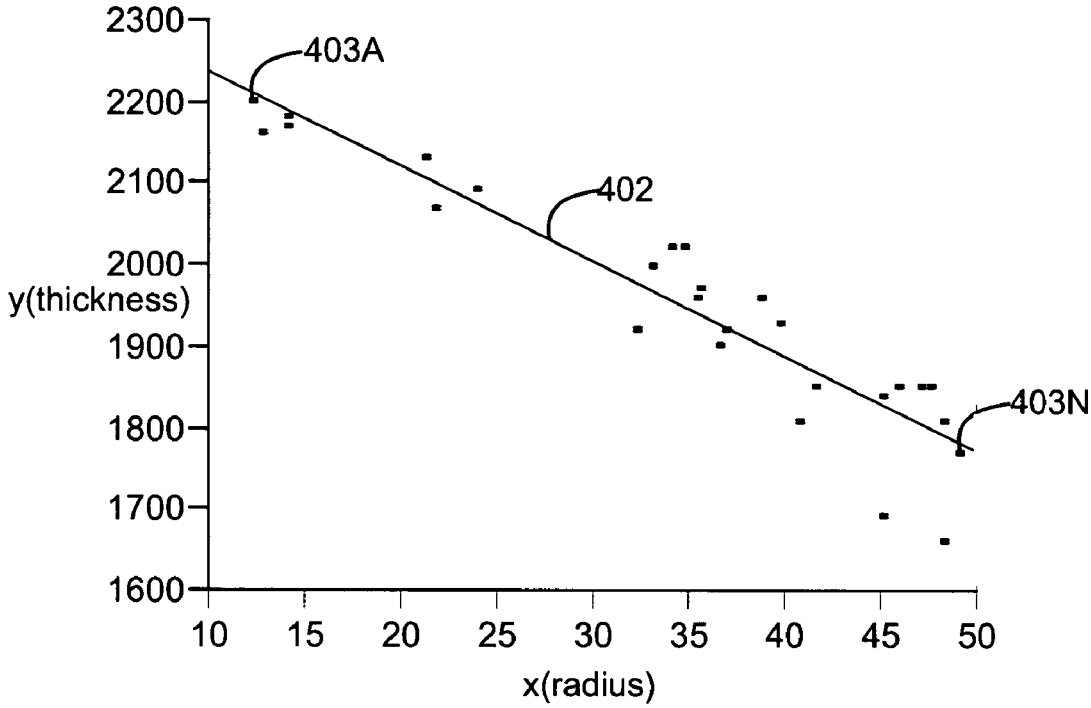
FIG. 4B illustrates, in a graph, fitting of 28 measurements to a straight line model, in one embodiment of the invention.

Measurements at the locations 401A-401N (FIG. 4A) for each wafer are then used in thickness v/s radius regression, to find the best linear fit, thereby to yield a slope of the straight line, and R-square as illustrated in FIG. 4B. Specifically, the slope of straight line 402 that best fits the measurements 403A-403N (at the respective locations 401A-401N) is used to compute the CTE thickness (which is an abbreviation of "center-to-edge"), as follows:

$$CTE\ \text{thickness} = -52.5 * \text{slope}$$

Figure 3A:
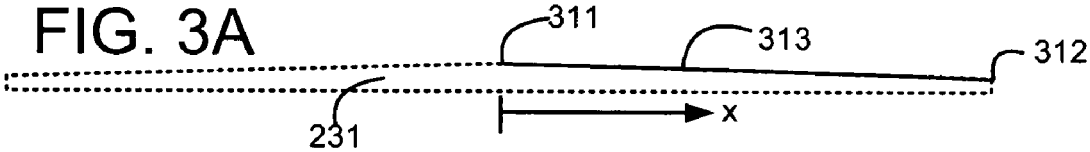
FIG. 3A illustrates a straight line model of the center-to-edge profile of a surface of a wafer after chemical mechanical polishing, used in certain embodiments of the invention.

Note that 52.5 mm is the radial distance x between the center of a 125 mm wafer and its edge with 10 mm edge exclusion. Note that radial distance x is shown in FIGS. 3A and 4B.

Figure 4C:
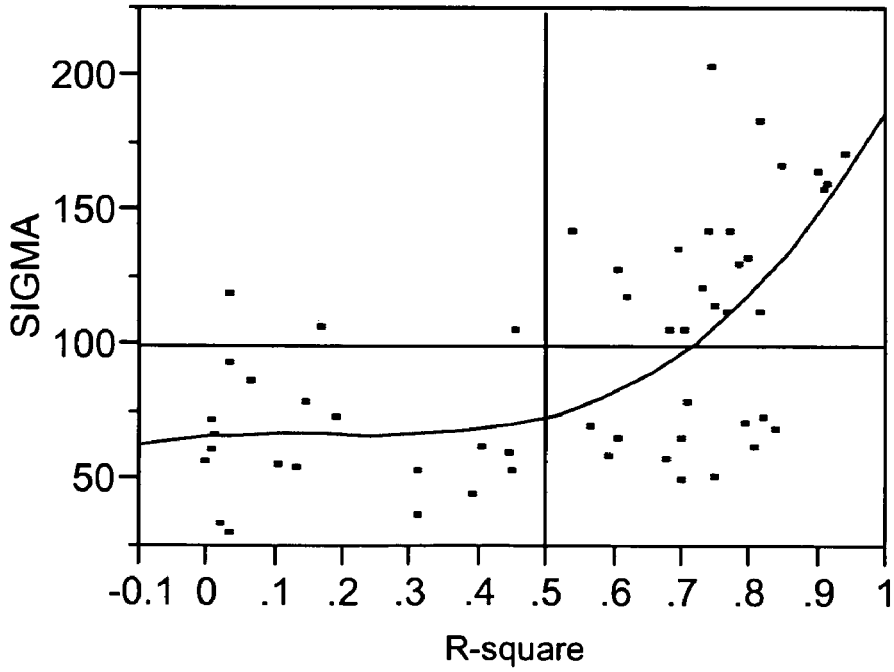
FIG. 4C illustrates, in a graph, a line showing the relation between sigma and R-square, and the dots show measurement data.
Figures 4D, 4E:
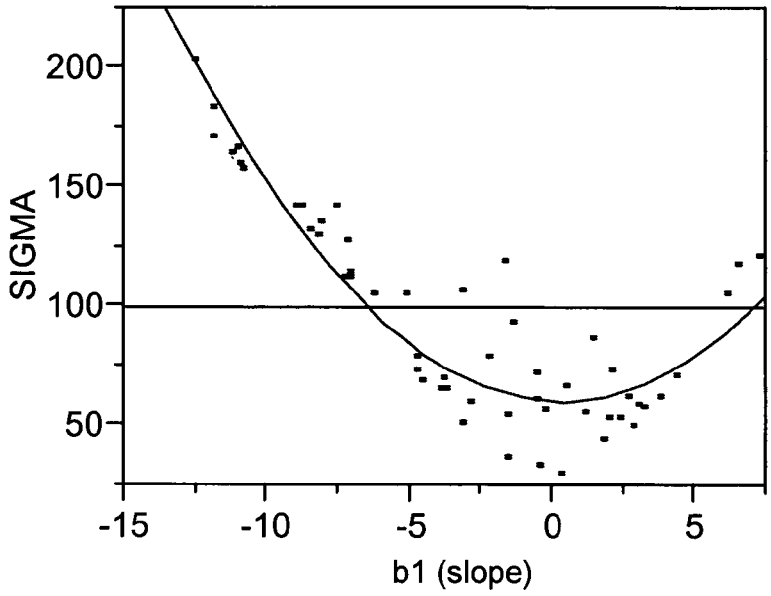
FIG. 4D illustrates, in a graph, a line showing the relation between sigma and center to edge slope, and the dots show measurement data.
FIG. 4E illustrates, in a table, tests that are applied to three parameters namely (a) R-square, which is shown as "R2", (b) the difference in thickness between the center and edge as computed from a slope of the straight line model, which is shown as "CTE" and (c) the current backside pressure, which is shown as "BSP."

Note that in the exemplary embodiment, the thickness of wafer prior to planarization includes a gradient non-uniformity (which is in addition to the radial non-uniformity shown in FIG. 4A). However, use of the center-to-edge slope to control backside pressure if coefficient of determination R-square is greater than a predetermined threshold of 0.4 decouples the gradient non-uniformity from the radial non-uniformity. Specifically, FIG. 4C shows relation between sigma and R-square, wherein when the R-square is high, then sigma is higher. For this reason, in this exemplary embodiment, a threshold of 0.4 is used. FIG. 4D shows relation between sigma and slope, which shows that a slope falls within the range +4 and −4 which in turn yields a range for CTE thickness of +200 and −200 (based on multiplying by 52.5 as noted in the previous paragraph). Such limits are therefore used in formulating the tests shown in FIG. 4E. Note that in this example, the actual CTE thickness limits in the table of FIG. 4E are selected to be −100 to +200 instead of −200 to +200 because, based on past experience in wafer fabrication, wafers that are center thick result in better quality product. Similarly, the limits on BSP in FIG. 4E are selected from experience, as being the upper bound of 2.4 and lower bound of 1.6, because wafers processed within this range provide better results for subsequent wafer fabrication.

Run-to-run, center-to-edge thickness based control of backside pressure for CMP radial uniformity optimization of an exemplary embodiment is implemented as follows. CMP uniformity is controlled by using optimized BSP adjustment from CTE thickness feedback and logic tests as shown in FIGS. 4F and 4G. Backside pressure is the control variable. CTE slope and R-square of CTE slope are the model's outputs that are used from a current run as feedback information to optimize backside pressure setting for the next run. CTE slope is a measurement of radial non-uniformity and R-square is used for decoupling the radial non-uniformity from gradient non-uniformity. Limit tests are first applied to both of these responses as shown in FIG. 4F, and the results were passed into the logic tests shown in FIG. 4G to make a decision to increase or decrease backside pressure setting. The logic tests of FIG. 4G also take input from a limit test of backside pressure value to prevent making adjustment beyond safe operating limit. By using this method, the backside pressure setting is continuously optimized by the run-to-run controller.

Note that the exemplary embodiment is implemented on a wafer that is being fabricated to contain twenty-thousand read-write heads, of the type illustrated in FIG. 4H. Specifically, the CMP process is performed on layer 410 which is the first write pole layer N4, and also on layer 412 (formed of NiFe) and alumina layer 422 over which the second pole layer 426 is later formed (in which second write pole 430 is shown).

The CTE slope and R-square for the exemplary embodiment are obtained by performing CTE thickness vs radius linear regression for every single wafer using the 28 point thickness measurements as described next. Specifically, the measurement data is received in pairs of independent and dependent variables {(xi,yi): i=1, . . . ,n}, wherein xi is the radius from the center of the wafer and yi is the thickness of the uppermost layer in the wafer as shown in FIG. 4B. The fitted equation is written as follows:

$$\hat{y} = b_0 + b_1 x$$

$\hat{y}$ is a predicted value of the thickness obtained by using the above equation.

In one specific example, the slope $b_1$ and intercept $b_0$ of the model are calculated by using the following equations, wherein $x_i$ and $y_i$ are respectively the radius and thickness measurement at that radius, at a point i, and as noted above there are 28 such points in this example.

$$\bar{x} = \frac{\sum_{i=1}^{n} x_i}{n}$$

$$\bar{y} = \frac{\sum_{i=1}^{n} y_i}{n}$$

$$b_1 = \frac{\sum_{i=1}^{n} (x_i - \bar{x})(y_i - \bar{y})}{\sum_{i=1}^{n} (x_i - \bar{x})^2}$$

$$b_0 = \bar{y} - b_1 \bar{x}$$

After calculation of b1 and b0 from the 28 measurements, then $\hat{y}_i$ is calculated for each point i using the corresponding $x_i$, using the equation:

$$\hat{y}_i = b_0 + b_1 x_i$$

This value $\hat{y}_i$ is then used with the mean to obtain R-square as shown below. R-square is a mathematical term representing the proportion of variation in the response data that is explained by the regression model.

$$R^2 = \frac{\sum_{i=1}^{n} (\hat{y}_i - \bar{y})^2}{\sum_{i=1}^{n} (y_i - \bar{y})^2}$$

Note that CTE thickness as used in the limit test of FIG. 4E is $(-52.5*b_1)$.

Although the present invention is illustrated in connection with specific embodiments for instructional purposes, the present invention is not limited thereto. Various adaptations and modifications may be made without departing from the scope of the invention. For example, different wafers can be planarized in the manner described above. Moreover, although a single computer 220 is illustrated in FIGS. 2A and 2C, a number of computers may be used in other embodiments. For example, one embodiment uses a server computer to implement method 240 (FIG. 2B), and the server computer in turn is coupled to a GEM/SECS computer located within CMP tool 100 (wherein the word GEM stands for "Generic Model For Communications And Control Of Manufacturing Equipment" and the word SECS stands for "SEMI Equipment Communications Standard").

The server computer of this embodiment is also coupled to a manufacturing execution system (MES), which is responsible for control of the manufacturing process as a whole (e.g. for flow of wafer cassettes and lots through a fab in which the items of FIG. 2A are located). Furthermore, in this embodiment, metrology from tool 210 is first stored in the database, and it is retrieved from the database by the server computer when computing the backside pressure for the next run. Also, in this particular embodiment, the server computer supplies the backside pressure to CMP tool 100 as a portion of a recipe for planarizing wafer 232.

In some embodiments, with Advanced Process Control (APC) run to run closed loop control, BSP helps improve wafer non-uniformity WIWNU. The predicted polishing optimized back-side pressure (BSP) are estimated based on historical run to run center-to-edge uniformity (CTE) data. The predicted polishing optimized BSP will be updated when feedback is available and it will be used as BSP settings for every wafer. APC with integrated metrology can speed up the feedback of run to run control. With R2R CTE-BSP Control of one embodiment, the CMP WIWNU was found by the inventors to have improved 20-30%.

Numerous such modifications and adaptations of the embodiments described herein are encompassed by the attached claims.

What is claimed is:

1. A method of planarizing wafers, the method comprising:

measuring thickness of a layer of a wafer already planarized by chemical mechanical polishing, the thickness being measured at a plurality of locations on the wafer to yield a plurality of measurements;

automatically fitting the plurality of measurements to a model of a profile of the wafer;

automatically computing a new backside pressure to be used in chemical mechanical polishing based on the model; and planarizing another wafer by chemical mechanical polishing, at the new backside pressure obtained from automatically computing.

2. The method of claim 1 wherein said "automatically computing" uses the model only if an indication of fit of the measurements to the model satisfies at least one predetermined test.

3. The method of claim 1 wherein said automatically computing comprises:

checking if a difference in thickness between the center and edge of the wafer, as determined from the model, is below, within, or above a predetermined range.

4. The method of claim 3 wherein:

said automatically computing comprises keeping a current value of backside pressure unchanged if the difference in thickness is within the predetermined range.

5. The method of claim 3 wherein:

said automatically computing comprises decreasing a current backside pressure by a predetermined amount if the difference in thickness is less than a second limit and if the current backside pressure is greater than a third limit.

6. The method of claim 3 wherein:

said automatically computing comprises increasing a current backside pressure by a predetermined amount if the difference in thickness is greater than a second limit and if the current value of the backside pressure is lower than a third limit.

7. The method of claim 3 wherein:

said automatically computing comprises keeping the current backside pressure unchanged if the current backside pressure is greater than a second limit.

8. The method of claim 3 wherein:

said automatically computing comprises keeping the current backside pressure unchanged if the current value of the backside pressure is lower than a second limit.

9. The method of claim 2 wherein the indication of fit comprises:

coefficient of determination "R-square" of the model.

10. A method of controlling operation of a chemical mechanical polishing tool, the method comprising:

receiving a plurality of measurements of thickness of at least one layer of a wafer from a metrology tool;

fitting the plurality of measurements to a straight line;

computing a backside pressure by using at least (a) a slope of the straight line, and (b) an indication of fit of the plurality of measurements to the straight line; and supplying the backside pressure to the chemical mechanical polishing tool, to control operation thereof.

11. A computer programmed to automatically control operation of a chemical mechanical polishing tool, the computer comprising:

means for receiving a plurality of measurements of thickness of at least one layer of a wafer from a metrology tool;

means for fitting the plurality of measurements to a straight line;

means for computing a backside pressure by using at least (a) a slope of the straight line, and (b) an indication of fit of the plurality of measurements to the straight line; and means for supplying the backside pressure to the chemical mechanical polishing tool, to control operation thereof.

12. A computer readable storage medium having stored therein a plurality of sequences of instructions, said plurality of sequences of instructions comprising instructions which, when executed by a computer, cause the computer to automatically:

receive a plurality of measurements of thickness of at least one layer of a wafer from a metrology tool;

fit the plurality of measurements to a straight line;

compute a backside pressure by using at least (a) a slope of the straight line, and (b) an indication of fit of the plurality of measurements to the straight line; and supply the backside pressure to the chemical mechanical polishing tool, to control operation thereof.

13. A method of planarizing wafers, the method comprising:

measuring thickness of a layer of a first wafer already planarized by chemical mechanical polishing, the thickness being measured at a plurality of locations on the first wafer to yield a plurality of measurements;

automatically determining a backside pressure to be used in chemical mechanical polishing in future, based at least on the plurality of measurements of the first wafer, by (i) keeping a current value of backside pressure unchanged if an indication of fit of the plurality of measurements to a line is less than or equal to the first limit, (ii) keeping the current value of backside pressure unchanged if the difference in thickness between the center and the edge of the wafer as determined from the line is within a predetermined range between the second limit and the third limit, (iii) decreasing the current value of backside pressure by a predetermined amount if the indication of fit of the plurality of measurements to the line is above the first limit and if the difference in thickness is below the second limit, wherein the second limit is smaller than the third limit, (iv) increasing the current value of backside pressure by a predetermined amount if the indication of fit of the plurality of measurements to the line is above the first limit and if the difference in thickness is above the third limit wherein the second limit is smaller than the third limit and if the current value of the backside pressure is lower than a fourth limit, (v) keeping the current value of backside pressure unchanged if the current value of the backside pressure is greater than the fourth limit; and planarizing another wafer by chemical mechanical polishing at said backside pressure.

14. The method of claim 1 wherein:

the model is a straight line;

said "automatically fitting" comprises using at least a slope of the straight line in the model, when determining the backside pressure.

15. The method of claim 1 wherein:

the model is a straight line that approximates a portion of said profile between the center and edge of the wafer;

said "automatically computing" comprises applying at least a first limit to coefficient of determination R-square of the model to check if a predetermined test is satisfied; and said "automatically computing" further comprises applying at least a second limit and a third limit to a difference in thickness between the center and edge as computed from a slope of the straight line.

16. The method of claim 1 wherein:

said "automatically computing" comprises determining the new backside pressure using at least one parameter from the model.

17. The method of claim 16 wherein:

the model is a line;

said parameter is a slope of the line;

said "automatically computing" comprises using an indication of coefficient of determination R-square of the model.

18. The method of claim 1 wherein the model is a straight line and said "automatically computing" comprises:

applying at least a first limit to an indication of coefficient of determination R-square of the model, and applying at least a second limit and a third limit to a difference in thickness between the center and edge as computed from a slope of the straight line.

19. The method of claim 18 wherein said "automatically computing" comprises:

keeping a current value of backside pressure unchanged if an indication of coefficient of determination R-square of the model is less than or equal to the first limit;

keeping the current value of backside pressure unchanged if a difference in thickness between the center and edge as computed from a slope of the straight line is within a predetermined range between the second limit and the third limit;

decreasing the current value of backside pressure by a predetermined amount if the indication of coefficient of determination R-square of the model is above the first limit and if the difference in thickness is below the second limit, wherein the second limit is smaller than the third limit;

increasing the current value of backside pressure by a predetermined amount if the indication of coefficient of determination R-square of the model is above the first limit and if the difference in thickness is above the third limit wherein the second limit is smaller than the third limit and if the current value of the backside pressure is lower than a fourth limit; and keeping the current value of backside pressure unchanged if the current value of the backside pressure is greater than the fourth limit.

20. The method of claim 1 wherein said "automatically computing" uses the model only if the model satisfies at least one predetermined test.

21. The method of claim 2 wherein:

a current backside pressure, used in a run prior to measuring, is kept unchanged if the indication of fit fails to satisfy the predetermined test.

* * * * *